US008322890B2

(12) United States Patent
Pabst et al.

(10) Patent No.: US 8,322,890 B2
(45) Date of Patent: Dec. 4, 2012

(54) LIGHT MODULE

(75) Inventors: Wolfgang Pabst, Deisenhofen (DE); Robert Kraus, Regensburg (DE)

(73) Assignee: Osram AG, Munich (DE)

( * ) Notice: Subject to any disclaimer, the term of this patent is extended or adjusted under 35 U.S.C. 154(b) by 199 days.

(21) Appl. No.: 12/188,032

(22) Filed: Aug. 7, 2008

(65) Prior Publication Data

US 2009/0040766 A1 Feb. 12, 2009

(30) Foreign Application Priority Data

Aug. 10, 2007 (DE) ..... 10 2007 037 821

(51) Int. Cl.
*F21V 29/00* (2006.01)

(52) U.S. Cl. ..... 362/294; 362/208; 362/362; 362/373

(58) Field of Classification Search ..... 362/294, 362/208, 362, 373
See application file for complete search history.

(56) References Cited

U.S. PATENT DOCUMENTS

| | | | | |
|---|---|---|---|---|
| 3,512,027 | A | 5/1970 | Kupsky | |
| 3,739,241 | A | 6/1973 | Thillays | |
| 3,946,416 | A | 3/1976 | Hacskaylo | |
| 4,394,679 | A * | 7/1983 | Hawrylo | 257/99 |
| 4,819,139 | A * | 4/1989 | Thomas | 362/183 |
| 6,145,986 | A * | 11/2000 | Conner | 351/158 |
| 6,492,725 | B1 | 12/2002 | Loh et al. | |
| 6,636,107 | B2 * | 10/2003 | Pelly | 327/552 |
| 6,802,620 | B2 * | 10/2004 | Galli | 362/116 |
| 6,874,908 | B2 * | 4/2005 | Sharrah et al. | 362/187 |
| 6,874,910 | B2 * | 4/2005 | Sugimoto et al. | 362/294 |
| 7,153,004 | B2 * | 12/2006 | Galli | 362/373 |
| 7,490,958 | B1 * | 2/2009 | Stoddard | 362/253 |
| 7,578,604 | B2 * | 8/2009 | Lee | 362/294 |
| 7,598,686 | B2 * | 10/2009 | Lys et al. | 315/312 |
| 7,621,653 | B2 * | 11/2009 | Hendrie | 362/231 |
| 7,635,212 | B2 * | 12/2009 | Seidler | 362/545 |
| 7,731,385 | B2 * | 6/2010 | Spartano et al. | 362/197 |
| 2005/0231983 | A1 | 10/2005 | Dahm | |
| 2007/0153526 | A1 | 7/2007 | Lim | |

FOREIGN PATENT DOCUMENTS

| | | | |
|---|---|---|---|
| DE | 202006018985 | U1 | 5/2007 |
| EP | 1117135 | A2 | 7/2001 |
| JP | 359136911 | * | 8/1984 |
| WO | 2008071178 | A1 | 6/2008 |

* cited by examiner

*Primary Examiner* — Jong-Suk (James) Lee
*Assistant Examiner* — Mark Tsidulko

(57) ABSTRACT

A light module has at least one light source mounted on a base, especially an LED, a housing to accommodate the base, an electrical connection element for power supply of at least one light source. An outer line of the connection element is formed by the housing, and an inner line, especially center line, of the connection element, which is at least partially enclosed by the outer line, contacts the base.

25 Claims, 3 Drawing Sheets

LIGHT MODULE

CROSS-REFERENCE TO RELATED APPLICATIONS

This application claims priority to German application number 10 2007 037 821.3 filed Aug. 10, 2007, the contents of which is hereby incorporated by reference in its entirety.

TECHNICAL FIELD

The invention concerns a light module, especially an LED module, and a system, consisting of a light module and a power connection.

BACKGROUND

Thus far, many LED modules have a housing that has an ordinary, separately designed plug connection for power supply to the light-emitting diode(s) (LED).

However, such plugs are not used to support the operating method of LED elements or modules.

SUMMARY

An improved utilization of an electrical plug connection during operation of a light module, especially of an LED module, can be provided.

According to an embodiment, a light module may comprise at least one light source mounted on a base, a housing accommodating the base, and an electrical connection for power supply of the at least one light source, wherein an outer line of the electrical connection is formed by the housing and an inner line or a center line of the electrical connection contacts the base.

According to a further embodiment, the inner line may be connected in a heat-conducting fashion to the base. According to a further embodiment, the outer line may be formed in one piece with the housing. According to a further embodiment, the outer line and the housing may consist of a heat-conducting material or metal. According to a further embodiment, the inner line may comprise heat-conducting material or metal. According to a further embodiment, an electrically-insulating filler material may be present between the outer line and the inner line. According to a further embodiment, the electrical connection further may comprise an intermediate line, which is arranged at least partially or concentrically between the outer line and the inner line. According to a further embodiment, the light module may be setup for operation with DC, wherein the intermediate conductor lies at a positive voltage potential, while the outer conductor is grounded. According to a further embodiment, the light module may be setup for operation with AC, wherein an N-phase lies on the intermediate conductor, an L-phase lies on the center conductor and the outer conductor is connected to ground. According to a further embodiment, the housing may form a reflector, which reflects the light outward from the at least one light source. According to a further embodiment, the housing may be designed tubular, one tube end being set up to emit the light outward from light source and the other tube end including the electrical connection. According to a further embodiment, the housing may comprise a connection device or outside thread. According to a further embodiment, the electrical connection may comprise at least one additional electrical connection line or a control line for operation of the at least one light source, which is passed between the outer line and the inner line. According to a further embodiment, the at least one additional electrical connection line may be passed through an electrically-insulating filler material. According to a further embodiment, the at least one control line may be designed as a coaxial cable. According to a further embodiment, the housing may comprise cooling ribs. According to a further embodiment, the light module may be designed as part of a heat pipe. According to a further embodiment, the inner line may be designed as a heat pipe.

According to a further embodiment, a system may comprise such a light module and a power connection, wherein the electrical connection of light module and a connection mating element of the power connection are operable to be connected to each other, wherein an outer line of the power connection and the outer line of the light module form a heat transfer contact surface or an inner line of the power connection and the inner line of the light module form a heat transfer contact surface. According to a further embodiment, the power connection may be connected to a heat sink. According to a further embodiment, the light module and the power connection may form a heat pipe for cooling of the light module. According to a further embodiment, the light module may be water coolable via the power connection. According to a further embodiment, the power connection and the light module may be operable to be forced one onto the other by means of a connection device or an outside thread or nut. According to a further embodiment, a contact layer may be arranged between the light module and the power connection. According to a further embodiment, the contact layer may comprise a contact paste, a metal foil, a metal spring or a sleeve filled with gel. According to a further embodiment, the electrical connection of the light module and the power connection may be designed matching each other with at least one additional electrical connection line or a control line for operation of the at least one light source. According to a further embodiment, the matching additional electrical connection line of the light module and the power connection may comprise a contact pin or contact bushing on the contact side.

BRIEF DESCRIPTION OF THE DRAWINGS

FIG. 1 shows, as a cross-section side view, a sketch of a light module 1.

DETAILED DESCRIPTION

Figure 1:
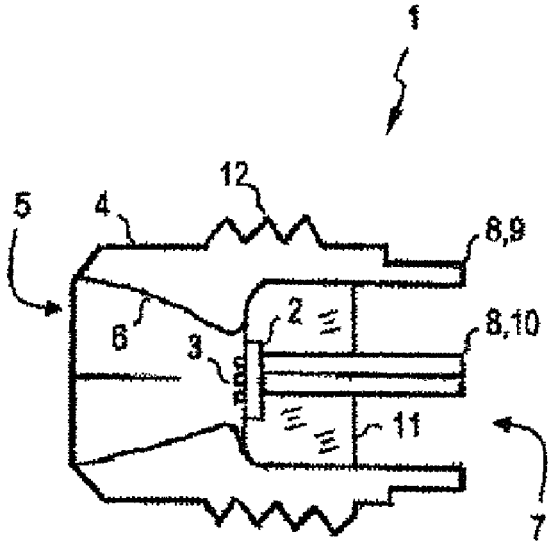
FIG. 1 shows, as a cross-section in a side view, a sketch of a light module.

According to an embodiment, the light module may have at least one light source mounted on a base, a housing to accommodate the base and an electrical connection element for power supply of at least one light source. An external line of the connection element is also formed by the housing and an internal line, especially a center line of the connection element, is enclosed at least partially by the outer line and contacts the base. A connection of the electrical feed lines to the at least one light source is well known to one skilled in the art and need not be further discussed here.

Owing to the fact that the outer line is formed by the housing, it is possible to use the electrical connection element for heat conduction, in addition to electrical conduction, which is not reasonably possible in ordinary plugs with their cable and wire connections. Owing to the fact that the inner line contacts the base, for example, gluing, soldering and/or mechanical fastening, significant heat conduction from the base is also made possible via the inner cable. This is particularly advantageous for cooling of the LED module, since the heat of the housing and/or base generated by the LED(s) can be taken off in compact and efficient fashion.

The base may be preferably a metal core plate, preferably having a structured copper layer on a dielectric, for example, made of polyimide or epoxy resin, as well as a substrate, for example, made of aluminum, copper or another metal. Heat generated on the plate is then taken off particularly effectively via the cross-sectional area. As an alternative, other plate materials, like FR4 or a so-called flex foil, can also be used. The base can also have through contacts for electrical connection of the front, on which the LEDs are mounted, to the back, which is in contact with the center conductor.

It may be advantageous for heat removal from the light module or for cooling of the light module, if the inner line of the connection element is connected heat-conducting to the base.

To avoid heat-conduction resistances, it may be also advantageous, if the outer line of the connection element is formed in one piece with the housing.

It may be particularly advantageous for efficient heat removal, if the outer line in the housing consists of heat-conducting material, especially with a heat conductivity coefficient of >10 W/mK, especially made of metal.

As an alternative or in addition, it can be advantageous for heat removal, if the inner line has heat-conducting material, especially metal.

It may be preferred, for mechanical stabilization and electrical reliability, if an electrically-insulating filler is present between the outer line and the inner line. Teflon can be preferred for insulation material, but other non-conducting materials can also be used, including organic materials.

For efficient and reliable current feed, it can be advantageous, if the connection element also has an intermediate line arranged at least partially between the outer line and the inner line.

The outer line and the inner line and/or intermediate line are advantageously arranged concentrically.

To achieve a simple design, compact dimensions and efficient heat removal, the housing, optionally with a reflective layer, for example, metallization, forms a reflector, which reflects light outward emitted from at least one light source.

A light module, in which the housing is designed tubular, one tube end being set up to release the light emitted from the light source outward and the other tube end enclosing the connection element, may be preferred.

The housing preferably may have a connection device for connection to a power connection, especially outside thread. As an alternative, part of a bayonet closure is present on the housing, which can be engaged with a connection mating element of the power connection.

The connection element preferably may have at least one additional electrical connection line for operation of at least one light source, especially at least one control line, which is preferably passed between the outer line and the inner line. By the additional provision of at least one control line, the function of the power connection is expanded to a control function. For example, a control circuit of the LED module, for example, a driver circuit, can be driven by means of the control line, so that light output can be flexibly adjusted. The power connection therefore at least partially assumes the functions of a control bus, but in very compact fashion.

To reduce influences of signal transmission, the at least one additional electrical connection line can be guided in an electrically-insulating filler material, especially Teflon.

To further reduce influences of signal transmission, the at least one control line may be designed as a coaxial cable.

The housing may have cooling ribs for further cooling of the LED module.

The light module can be designed as part of a heat tube as additional or alternative cooling type. The other part can be formed, for example, by means of the power connection.

The light module can be set up for operation with DC, in which a direct voltage is applied between two of the conductors. In the presence of the intermediate conductor, this may be preferably at a positive voltage potential, for example, +24 V, whereas the outer conductor is grounded. Additional control signals can then preferably be transmitted via the center conductor.

The light module, however, can also be setup for operation with AC, in which an N-phase lies on the intermediate conductor, an L-phase lies on the center conductor and the outer conductor lies at ground.

The inner line can be preferably designed as a heat pipe.

According to a further embodiment, a system may comprise such a light module and a power connection, in which the electrical connection element of the light module and a connection element of the power connection are adapted to each other for connection. An outer line of the power connection and the outer line of the light module may form a heat transmission contact surface and/or an inner line of the power connection and the inner line of the light module may form a heat transfer contact surface.

The power connection can be preferably provided with a heat sink for cooling of the LED module.

For particularly efficient cooling, the light module and the power connection can form a heat tube for cooling of the light module.

As an alternative, the light module can be water-cooled via the power connection.

A system, in which the power connection of the light module can be pressed by means of a connection device, especially outside thread or a nut, onto each other, may also be preferred. As an alternative, they can be connected to each other via a bayonet closure. Any other appropriate releasable, provisionally releasable or unreleasable connections can also be used.

To secure the connection or for contact improvement, a contact layer can be arranged between the LED module and the power connection. This contact layer may preferably include a contact paste, a metal foil, a metal spring or a sleeve filled with gel.

A system in which the connection element of the LED module and the power connection are formed matching each other also may preferably comprise at least an additional electrical connection line to operate at least one light source, especially a control line.

It may then be preferred, if the additional electrical connection line of the light module and the power connection arranged matching each other have a contact pin or bushing on the contact side. Assignment of the pin and bushing to one or the other element is then not restricted.

In the following schematic practical examples, the light module and the system of light module and a power connection are discussed more precisely. For simpler representation in several figures, the same or functionally equivalent or similar elements can then be provided with the same reference numbers.

The light module 1 is equipped with several LEDs 3 mounted on a base 2 as light sources. The base 2 and the LEDs 3 are accommodated in a housing 4 of essentially tubular design. The LEDs 3 emit light outward through the left open tube end 5 in this depiction. In order to increase light yield, the housing 4 is designed in the form of a reflector 6 in the area of the left tube end, which can also be coated reflecting.

The light module 1 also has an electrical connection element on the other right tube end 7 in the form of an electrical plug connection 8 for power supply of LEDs 3. The plug connection 8, for this purpose, has a tubular outer line 9 and an inner line in the form of a center line 10, which are arranged concentrically to each other. The outer line 9 of the plug connection is formed integral with the housing 4. An insulation filling 11 made of Teflon is inserted between the outer conductor 9 and inner conductor 10 for mechanical stabilization and improved electrical insulation.

From another viewpoint, the housing 4 can be viewed as part of the connection element 8; the outer line 8 on the left side of the figure can then be viewed as forming the light reflector 6.

The base 2 is situated in good electrical contact and heat contact with the end of the middle or central line 10 facing the base 2. When a voltage is applied to the outer line 9 and the center line 10, the LEDs 3 can be operated by it (wiring and driver elements not shown).

An outside thread 12 for fastening of a power connection is situated on the outer periphery of housing 4.

The depicted LED module 1 therefore has concentrically arranged elements 9, 10 for mechanical fastening and electrical and thermal joining to a power supply and a heat sink, as described more precisely further below. Light yield and lifetime can be increased on this account. Some or all elements of the LED module 1 are made from a well heat-conducting material.

Figure 2:
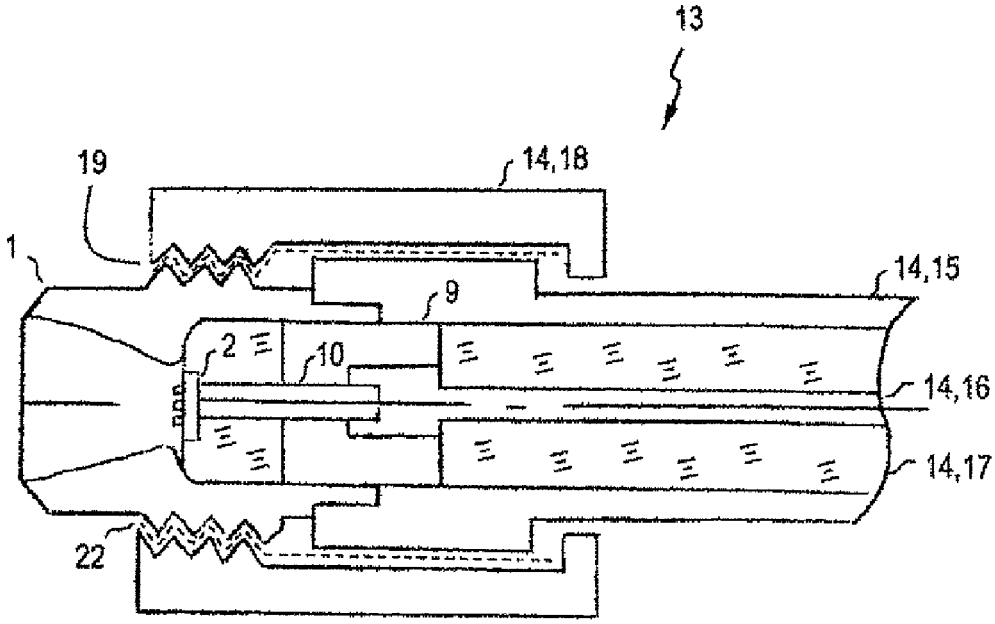
FIG. 2 shows, as a cross-section in a side view, a sketch of an assembled system of a light module from FIG. 1 and a power connection.

FIG. 2 shows, as a cross-section in a side view, a sketch of an assembled system 13 of light module 1 from FIG. 1 and a power connection with a connection mating piece in the form of a plug 14. The individual elements of LED module 1 are only described here for reasons of clarity to the extent that they are necessary for cooperation with the power connection. Their function can be derived from the description of FIG. 1.

The power connection on its connection end has a connection mating element that matches the LED module 1 in the form of a tubular plug 14, having the following elements: an outer line 15 for mechanical, electrical and thermal connection with the outer line 9 of LED module 1; an inner line 16 for mechanical, electrical and thermal connection to the inner line 10 of LED module 1 and an insulation filling 17 made of Teflon for mechanical stabilization and improved electrical insulation of lines 15, 16.

The plug 14 also has a nut 18 with inside thread 19, which is engaged with the outside thread of the LED module. By tightening the thread, the plug 14 is pressed onto the LED module, so that a large-surface well heat-conducting contact can form between the outer conductors 9, 15 and the inner conductors 10, 16 of LED module 1 and plug 14.

By connection of plug 14 and the power supply to a heat sink, for example, a cooler, heat can be withdrawn from the LED module 1 via the plug 14. For example, heat of the housing 4 of the LED module from FIG. 1 can be taken off via the outer conductor 15. An amount of heat of the base can be taken off via inner conductor 9, 16. When an intermediate conductor is present (without figure, see further below), heat can also be taken off via this.

A contact layer 22, drawn with a dashed line, is also arranged between the outer line 9 of the LED module and the nut 18 of plug 14. A contact paste, a metal foil, a metal spring, as well as a sleeve filled with gel, can serve as contact layer 22.

In addition to a screw connection, the tube ends can also be locked by means of a bayonet closure of another appropriate connection device. The described system is also characterized by the fact that a coding for different lamp powers and/or to distinguish between low-voltage supply and line voltage supply can be implemented by specific, different tube diameters or number of tubes.

As an alternative or in addition, the system for cooling can be designed as a heat pipe. In another alternative, liquid cooling can occur via the tubes.

Figure 3A:
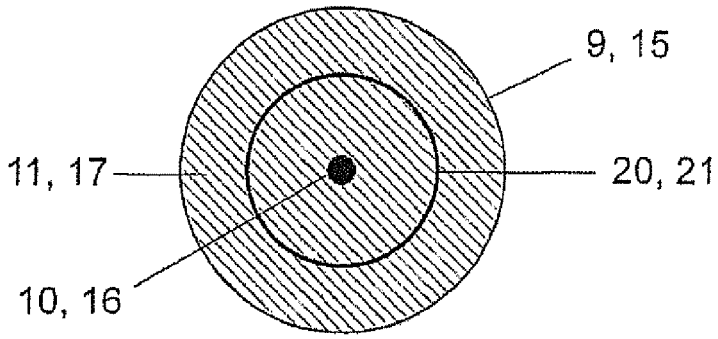
FIG. 3 shows, as a cross-section in a front view, a sketch of an electrical circuit of electrical lines of a light module and a power connection.
Figure 3B:
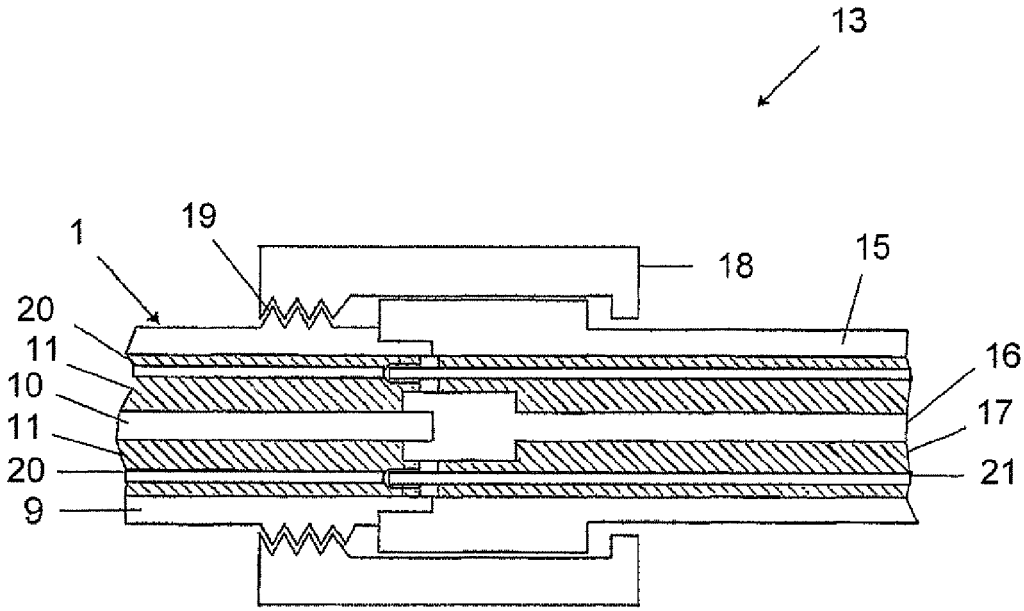

FIG. 3 shows, as a cross-section in a front view, a sketch of an electrical circuit of the electrical lines of the light module and the plug from FIG. 1 and FIG. 2. A tubular intermediate conductor 20 of the LED module and 21 of the plug is now present between the outer conductor 9 of the LED module and the outer conductor 15 of the plug concentrically. The space between the conductors is filled with Teflon 11 and 17 for electrical insulation of the conductors 9, 20, 10 and 15, 21, 16.

For a DC low-voltage supply, for example, of 24 V (so-called "DC mode"), the outer line 9 or 15 is connected to ground (null potential), the intermediate line 20 or 21 is exposed to +24 V and a control signal is passed along inner line 10 or 16, which is electrically shielded by the concentric tubes of the outer and intermediate lines 9, 10 and 15, 16.

This embodiment, in addition to the functional expansion from transmission of electrical energy to transmission of heat, has a further advantage that electrical control signals can now also be transmitted, which are also well shielded.

In the absence of intermediate conductor 20, 21, the outer line 9 or 15 is preferably connected to ground, whereas the center conductors 10 or 16 lie at a voltage that is applied to the light sources.

For line voltage supply of the LED module, which is operated, for example, at 230 V (so-called "AC mode"), the outer line 9 or 15 serves as ground. The alternating voltage is applied between the central line 10 or 16 and the intermediate line 20 or 21. The alternating voltage is preferably applied directly to these lines 20, 10 and 21, 16.

Figure 4:
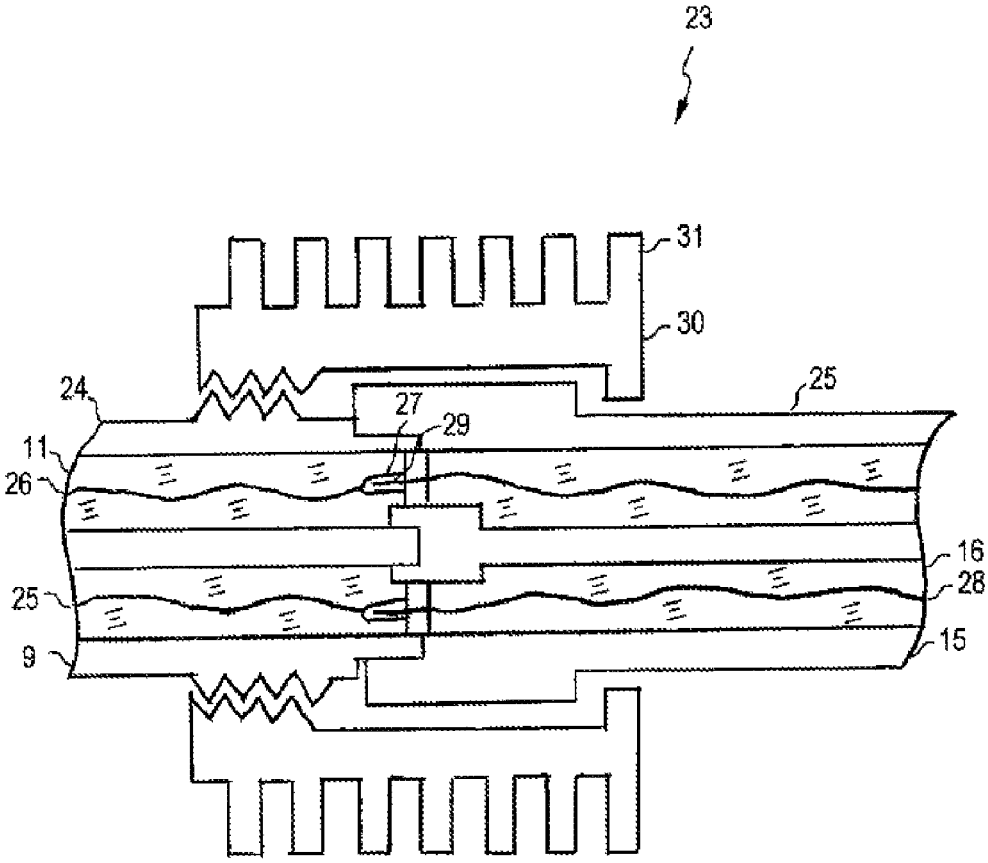
FIG. 4 shows, as a cross-section in a side view, a sketch of an assembled system of the light module and power connection according to another variant.

FIG. 4 shows, as another practical example, a cutout of a system 23 of light module 24 and power connection 25 and the individual elements, in which, in addition to the system according to FIG. 1 and FIG. 2 or FIG. 3, lines are present as additional electrical connections to control the LED module 24.

In particular, electrical lines 26 are embedded in the intermediate layer 11 of LED module 24 and have connection pieces in the form of contact bushings 27. Matching electrical lines 28 are embedded in the intermediate layer 16 of plug 25 and have connection pieces in the form of contact pins 29. The control lines 26, 28 in this example are shielded by the outer line 9 and 15 from E/M disturbances.

The control lines themselves can also be designed as coaxial cables, which permit particularly low-disturbance signal transmission.

The nut 30 of the plug also has cooling ribs 31, which causes an improved cooling effect of the connection mating element or plug 25.

The central line can also be designed in the form of a heat pipe.

The invention is naturally not restricted to the above practical examples. Other light sources can also be used, like laser diodes or lamps. The number and type of LEDs is not also restricted and can also include an individual LED. Single-color (also white) LEDs or LEDs of different color (for example, in the form of a cluster of LEDs of different color) can also be used. Also included, but not described, is the provision of optics for guiding of the light beam. Also included, but not depicted, is the provision of electrical or electronic components, like LED drivers.

LIST OF REFERENCE NUMBERS

1 Light module
2 Base
3 LED
4 Housing
5 Tube end
6 Reflector
7 Tube end
8 Connection element
9 Outer line
10 Center line
11 Insulation filling
12 Outside thread
13 System
14 Power connection/plug
15 Outer line
16 Inner line
17 Insulation filling
18 Nut
19 Inside thread
20 Intermediate line
21 Intermediate line
22 Contact layer
23 System
24 LED module
25 Power connection
26 Control line
27 Contact bushing
28 Control line
29 Contact pin
30 Nut
31 Cooling rib

What is claimed is:

1. A light module, comprising at least one light source mounted on a base;

an open-ended tubular housing accommodating the base, and a plug connection for power supply of the at least one light source, a center line of the plug connection mechanically contacting the base, one open end of the housing being set up to emit the light outward from light source and the other open end of the housing, being shaped as a tubular outer surface of the plug connection, and wherein the housing comprises an outside thread as a connection means.

2. The light module according to claim 1, wherein the center line is connected in a heat-conducting fashion to the base.

3. The light module according to claim 1, wherein the outer line is formed in one piece with the housing.

4. The light module according to claim 1, wherein the outer line and the housing consist of a heat-conducting material or metal.

5. The light module according to claim 1, wherein the center line comprises heat-conducting material or metal.

6. The light module according to claim 1, wherein an electrically-insulating filler material is present between the outer line and the center line.

7. The light module according to claim 1, wherein the electrical plug connection further comprises an intermediate line for power supply of the at least one light source, which is arranged at least partially or concentrically between the outer line and the center line.

8. The light module according to claim 7, setup for operation with DC, wherein the intermediate line lies at a positive voltage potential, while the outer line is grounded.

9. The light module according to claim 7, setup for operation with AC, wherein an N-phase lies on the intermediate line, an L-phase lies on the center line and the outer line is connected to ground.

10. The light module according to claim 7, wherein the outer line is a tubular line and wherein the intermediate line is a tubular line.

11. The light module according to claim 1, wherein the housing forms a reflector, which reflects the light outward from the at least one light source.

12. The light module according to claim 1, wherein the electrical plug connection comprises at least one additional electrical connection line or a control line for operation of the at least one light source, which is passed between the outer line and the center line.

13. The light module according to claim 12, wherein the at least one additional electrical connection line is passed through an electrically-insulating filler material.

14. The light module according to claim 12, wherein the at least one control line is designed as a coaxial cable.

15. The light module according to claim 1, being designed as part of a heat pipe.

16. The light module according to claim 1, wherein the center line is designed as a heat pipe.

17. A system comprising a light module according to claim 1 and a power connection, wherein the tubular outer surface of the plug connection of the light module and a tubular connection mating plug element of the power connection are operable to be plugged into to each other, and the power connection and the light module are operable to be forced one onto the other by means of the outside thread of the light module and a nut of the power connection.

18. The system according to claim 17, wherein the power connection is connected to a heat sink.

19. The system according to claim 17, wherein the light module and the power connection form a heat pipe for cooling of the light module.

20. The system according to claim 17, wherein the light module is water coolable via the power connection.

21. The system according to claim 17, wherein a contact layer is arranged between the light module and the power connection.

22. The system according to claim 21, wherein the contact layer comprises a contact paste, a metal foil, a metal spring or a sleeve filled with gel.

23. The system according to claim 17, wherein the electrical plug connection of the light module and the power connection are designed matching each other with at least one additional electrical connection line or a control line for operation of the at least one light source.

24. The system according to claim 23, wherein the matching additional electrical connection line of the light module and the power connection comprise a contact pin or contact bushing on the contact side.

25. The light module according to claim 1, wherein the housing comprises part of a bayonet closure.

* * * * *